United States Patent [19]

Persson

[11] 4,278,113

[45] * Jul. 14, 1981

[54] METHOD AND APPARATUS FOR DISTRIBUTING A DISINTEGRATED MATERIAL ONTO A LAYER FORMING SURFACE

[75] Inventor: Torsten B. Persson, Maarslet, Denmark

[73] Assignee: Scan-Web i/s, Risskov, Denmark

[ * ] Notice: The portion of the term of this patent subsequent to Jun. 12, 1996, has been disclaimed.

[21] Appl. No.: 971,360

[22] Filed: Dec. 20, 1978

Related U.S. Application Data

[63] Continuation-in-part of Ser. No. 862,035, Dec. 19, 1977, Pat. No. 4,157,724, which is a continuation of Ser. No. 717,384, Aug. 24, 1976, abandoned.

[30] Foreign Application Priority Data

Aug. 27, 1975 [GB] United Kingdom ..... 35429/75
Sep. 18, 1978 [GB] United Kingdom ..... 37205/78

[51] Int. Cl.[3] ..... B65B 1/14; B65B 1/16

[52] U.S. Cl. ..... 141/1; 19/304; 141/11; 141/131; 264/121; 425/83.1

[58] Field of Search ..... 19/304; 141/1, 11, 59, 141/69, 67, 129, 131; 264/87, 121, 122, 123, DIG. 75; 425/83.1

[56] References Cited

U.S. PATENT DOCUMENTS

| | | | |
|---|---|---|---|
| 2,714,749 | 8/1955 | Clark et al. | 19/156 |
| 2,931,076 | 4/1960 | Clark | 19/304 X |
| 3,581,706 | 6/1971 | Rasmussen | 118/312 |
| 3,886,629 | 6/1975 | Nakai | 19/156.3 |
| 4,060,360 | 11/1977 | Tapp | 19/304 |
| 4,074,393 | 2/1978 | Hicklin et al. | 19/303 |

*Primary Examiner*—Frederick R. Schmidt
*Attorney, Agent, or Firm*—Craig and Antonelli

[57] ABSTRACT

A method and an apparatus for distributing loose fibres or particles onto a moving web in an even layer thereon preparatory to production of a non-woven sheet of the fibre or particle material. The material is filled into a container having a generally V-shaped screen bottom extending crosswise over the moving web, and whipping members are rotated in the bottom space so as to whip the material adjacent the interior surface of the screen by a whipping movement causing the fibres or particles to be slung against the screen and the material to move in a flow lengthwise along the bottom surfaces, whereby when suction is applied to the outside of the screen bottom through the web the fibres or particles will get dispensed through the screen and deposited on the web. The combined whipping and slinging of the material contributes to a high capacity of the distribution.

39 Claims, 16 Drawing Figures

Figure 1:
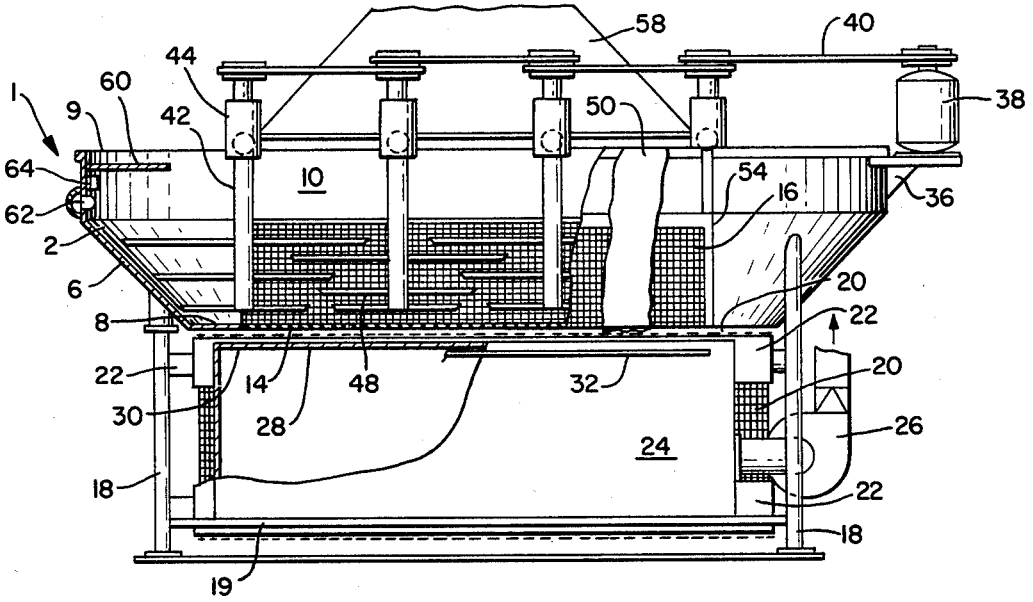

METHOD AND APPARATUS FOR DISTRIBUTING A DISINTEGRATED MATERIAL ONTO A LAYER FORMING SURFACE

This application is a continuation-in-part of co-pending U.S. application Ser. No. 862,035, filed Dec. 19, 1977, now U.S. Pat. No. 4,157,724 which in turn is a continuation application of U.S. Ser. No. 717,384, filed Aug. 24, 1976, now abandoned.

The present invention relates to a method of distributing loose fibres or particles onto a carrier surface constituted by a carrier web, by filling the fibre or particle material into a container having a screen wall portion located adjacent one side of said carrier web, agitating the material violently and creating an air flow through the material and through the said screen and web by sucking air from the other side of the web so as to cause the fibres or particles to gradually penetrate the screen and get deposited in a layer on the moving carrier web.

A method of this type and an apparatus for carrying out the method is disclosed in the British patent Specification No. 1,207,556 which corresponds to U.S. Pat. No. 3,581,706. The fibre material is filled into a circular cylindric vat having a plane, perforated bottom constituting the said screen wall portion and located parallel and close to the underlying, moving carrier web. For the agitation of the material near the screen bottom is used a stirring device comprising two vertical rotor shafts mounted in a planet gear arrangement overhead the vat and at their lower ends, just above the screen bottom, provided with radial, vertically oriented impeller fins or blades whirling around in the bottom material layer. Underneath the vat and the moving web is arranged a suction box which draws an air flow through the material in the vat and through the screen bottom and the web, whereby the disintegrated fibres near the bottom are drawn out and deposited on the moving web in a reasonably even layer thereon. The web moves the layer to a binding and curing station in which the layer is made into a non-woven sheet material for one of a wide variety of purposes.

By the agitation of the fibre material it is aimed to ensure that the fibres are kept mixed with the air and are caused to be repeatedly rearranged with respect to the adjoining fibres, whereby they will sooner or later get the opportunity to pass through the fine holes in the screen together with the suction air. The degree of rearrangement of the fibres is highest where the blade edge velocity is highest, i.e. an effective agitation is obtained in an annular area adjacent the outer blade edge portions. However, due to the centrifugal forces which tend to blow the material away from this area, it can be observed that for increasing impeller speed the dispensing capacity of the apparatus increases only to a certain point, whereafter it decreases, and in fact the obtainable maximum capacity is not as high as could be desirable.

According to another known method the fibre material is fed to the cylindric space between a lying rotating drum and a screen shell, the drum carrying a high number of radially protruding needles which serve to disintegrate and rearrange the fibre material. However, the material tends to be moved rapidly through the said space along with the drum surface, and hereby the velocity of the needles relative to the material is not by far as high as the absolute needle velocity, and the ability of the needles to cause rearrangement of the fibres, therefore, and therewith the dispensing capacity is correspondingly relatively low.

It is the purpose of this invention to provide a method whereby a high dispensing capacity is achieved in a simple manner.

According to the invention the material in the container is agitated by whipping it immediately inside the said screen wall portion. The term "whipping" as used here and in the following and in the appended claims is intended to be indicative of the act of repeatingly moving through the material to be whipped a relatively narrow heat member having proportions so as to cause disturbance in the configuration of submatters of the material along the moving path of the beat or whip member through the material, without to any substantial degree causing the material to move in the beating direction, such that the submatters along the moving path of the beat member are vividly separated and displaced. When a dry fibrous or otherwise loose material is whipped in this manner in air the fibres or particles are kept in air fluidized condition, and the whipping involves a high degree of rearrangement of the fibres or particles without forcing these to move along with the whip or beat members, and consequently the fibres or particles are readily sucked out through the holes in the screen wall portion, whereby a high dispensing capacity is ensured. An increased whipping speed primarily involves an increased rate of rearrangement of the fibres or particles and therewith an increased dispensing capacity within wide limits.

In practice it may be troublesome to effect whipping of the material adjacent all surface portions of the screen wall of the container, but tests have shown that excellent results are obtainable if the whipping is effected in spaced areas along the screen wall and the material is caused to be moved, relatively slowly, from one whipping area to the next. Once whipped the material remains in its air fluidized condition for some time, and if the whipping is repeated soon thereafter by virtue of the material being moved to the next whipping station along the screen the fibres or particles even in the material flow between the whipping stations will be readily dispensable through the screen holes.

The said movement of the material from one whipping station to the next and so forth is easily obtainable by means of the whipping members themselves, when they are moved in a unidirectional manner adjacent the screen so as to cause a general, relatively slow material movement therealong. This movement may well be rapid, in an absolute sense, but far less rapid than the velocity of the whipping members.

The invention further comprises an apparatus for carrying out the described method, as defined in the appended claims and as described in more detail below.

It should be mentioned already here that a very important aspect of the invention is the provision of rotary whip members which rotate in a plane non-parallel to the screen wall portion, whereby the whip members cause the material to be slung against the screen and therewith promote the penetration of the fibres or particles through the screen wall. The agitators may be mounted in a stationary manner, and the fast moving peripheral whip member portions may pass closely along a screen area without the remaining member portions, moving the smaller speed, being moved closely along the screen, whereby they might cause the fibre material to flocculate by rolling it rather than whipping it.

Figure 2:
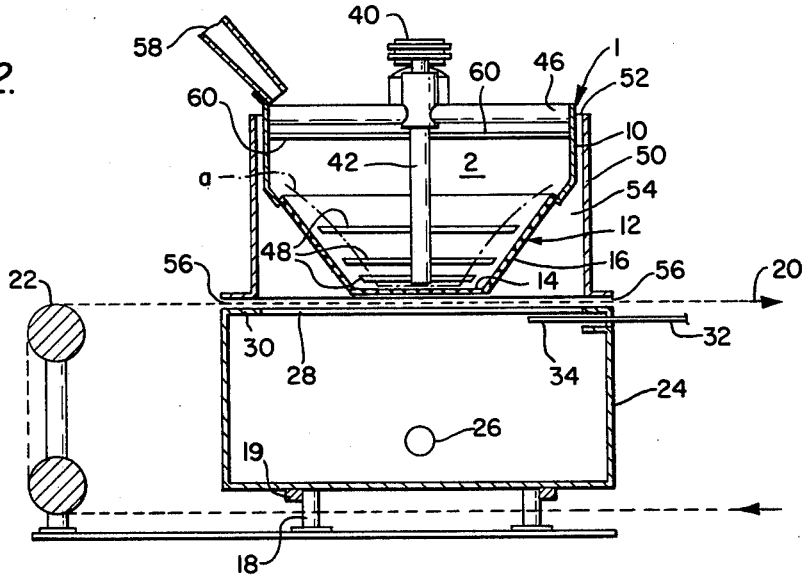
Figure 3:
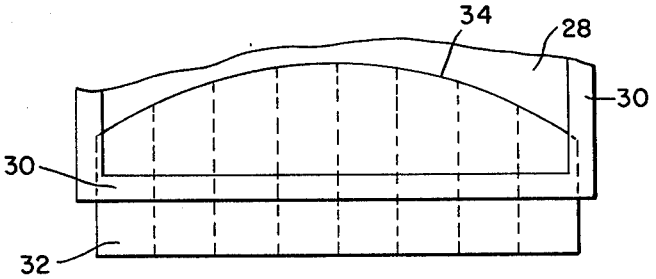
Figure 4:
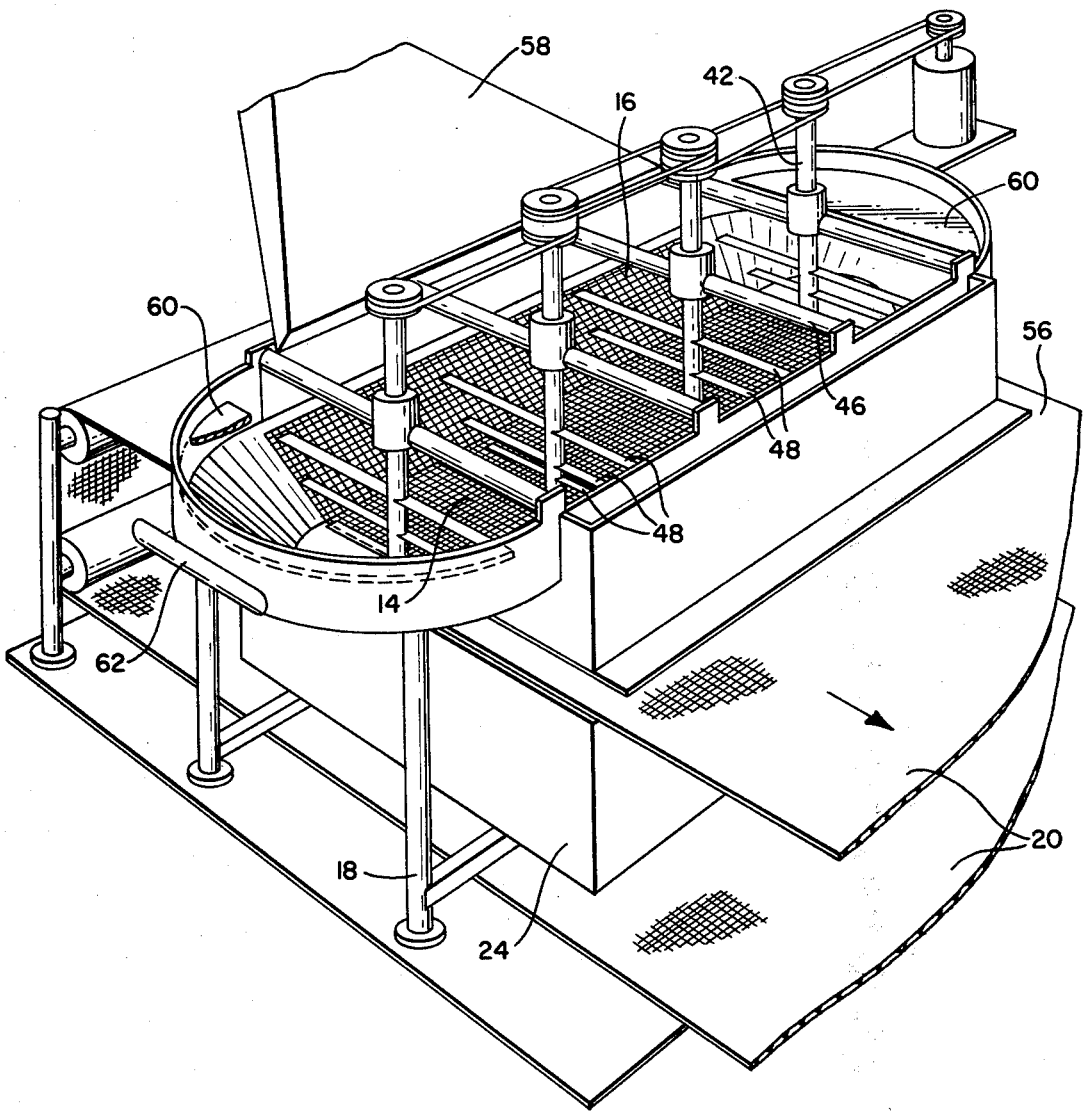
Figure 5:
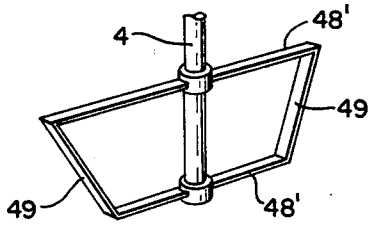
Figure 6:
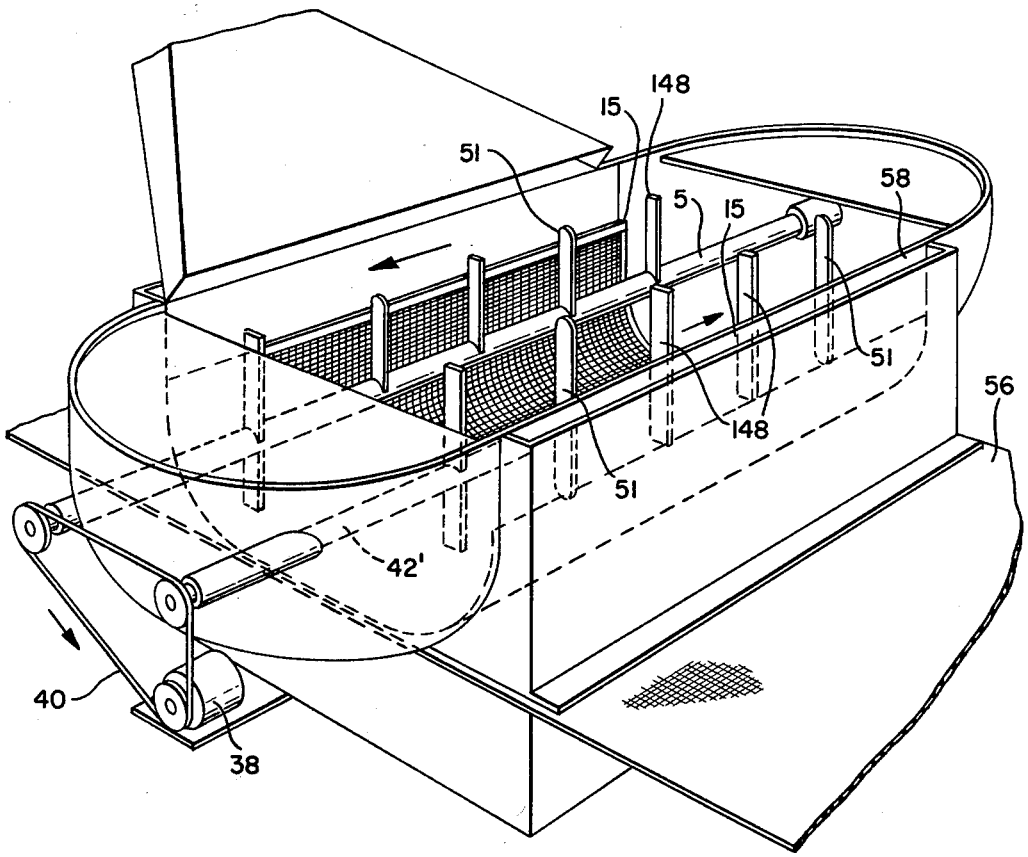
Figure 7:
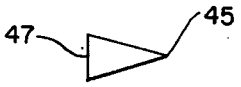
Figure 8:
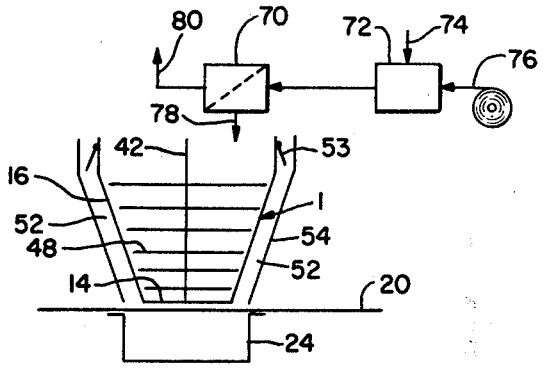
Figure 9:
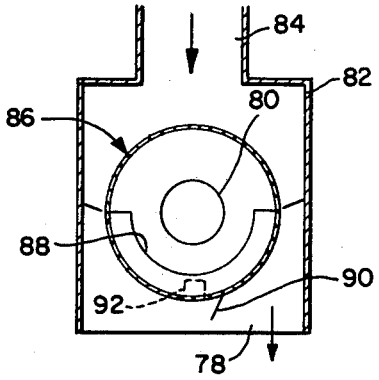
Figure 10:
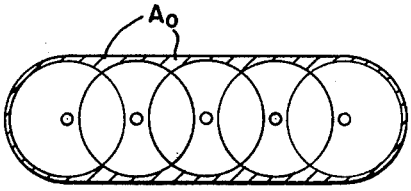
Figure 11:
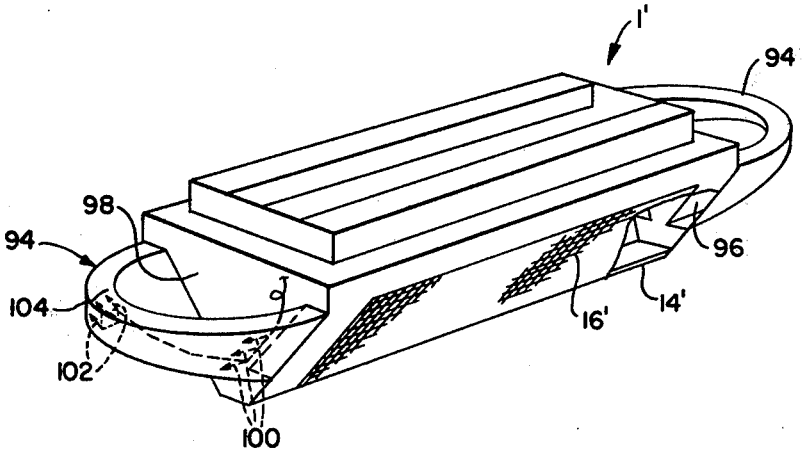
Figure 12:
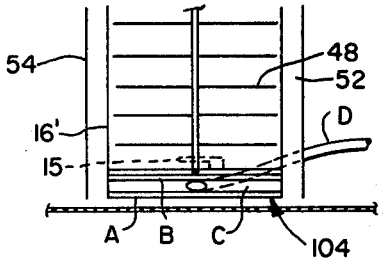
Figure 13:
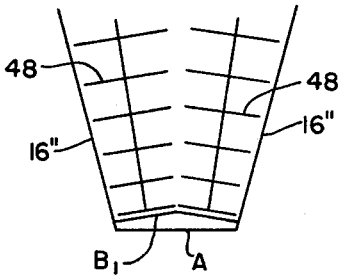
Figure 14:
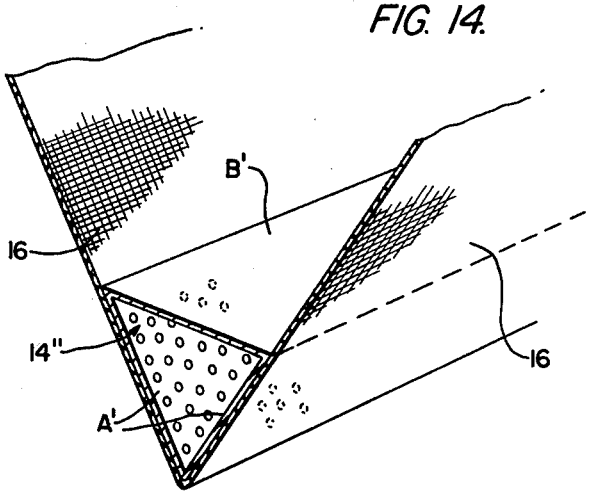
Figure 15:
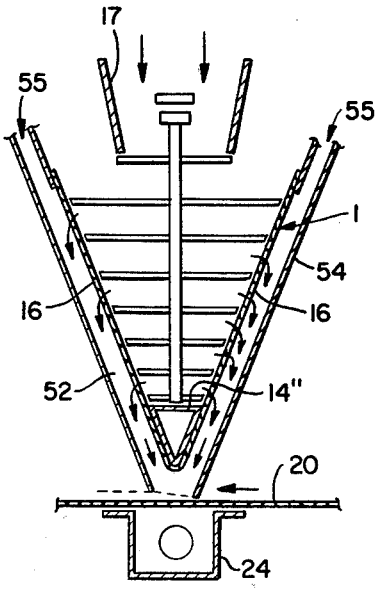
Figure 16:
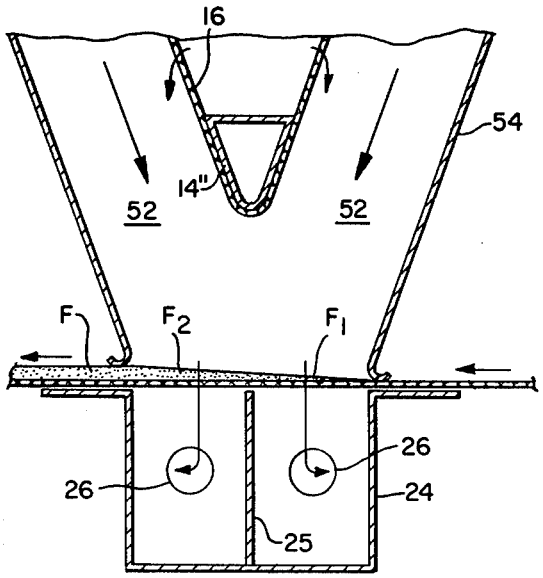

By way of example the invention will now be described in more detail with reference to the accompanying drawing, in which:

FIG. 1 is a side elevation, partly in section, of an apparatus according to a preferred embodiment of the invention, FIG. 2 is a cross sectional side view of this apparatus, FIG. 3 is a detail of FIGS. 1 and 2 as seen from above, FIG. 4 is a sectional perspective view of FIG. 1, FIG. 5 is a view of a modified detail, FIG. 6 is a general view of a modified apparatus according to the invention, FIG. 7 is a transverse cross-sectional view of one form of agitating member according to the invention, FIG. 8 schematically shows a modified form of the FIG. 2 distributor, FIG. 9 shows a vertical cross sectional view of an air/fiber separator, FIG. 10 is a horizontal cross sectional view of the agitator and screen of the FIG. 8 embodiment, FIG. 11 shows a further modified form of the distributor container, FIGS. 12 and 13 show still further distributor embodiments, FIGS. 14 and 15 show another modified distributor screen arrangement and a distributor with which it may be utilized, respectively, and FIG. 16 illustrates a modified vacuum arrangement utilized with the FIG. 15 embodiment.

FIG. 1 shows an elongated fibre distributor container generally designated 1 and shaped with half-rounded end portions 2, each of which having a vertical, cylindric upper portion 9 and a downwardly projecting bottom portion 6 of conical shape and a horizontal, half-circular bottom plate 8. The end portions 2 are interconnected by means of vertical side plates 10 between the upper portions 9, and these parts 2–10 are made of non-perforated metal sheet material. Between the side plates 10 and the end portions 6 and 8 there is mounted a screen as a whole designated 12 and penetratable by fibres and air and being of U-shaped cross section corresponding to the end portions 2, i.e. showing a plane horizontal bottom screen portion 14 and two slanting screen portions 16. The container 1 is supported by means of columns 18 cross-wise above a horizontal fibre layer forming web consisting of a finely meshed screen or wire netting 20 which is endlessly drawn about rollers 22 and driven by means of a drive station (not shown) in the direction shown by an arrow. A suction box 24 having an exhauster 26 is arranged beneath the screen 12 and the wire netting 20 and supported by means of beams 19 connected onto the columns 18. The suction box is closed in the bottom portion and the sides and has an upper opening 28 located close to the underside of the web 20, sealed thereagainst by means of sealing flanges 30. The suction box is in one side provided with a horizontal slide gate 32 having a curved edge portion 34 for controlling the suction area, as described in more detail below. At one end portion 4 there is provided a bracket 36 supporting a motor 38, which by means of a chain drive 40 drives four vertical axles 42 running in bearings 44 which are mounted onto cross bares 46 which again are supported at the side plates 10. The axles 42 are arranged in a row in the vertical plane of symmetry of the container and each provided with three pairs of diametrically opposed and radially mounted flat, elongated rotor members 48, the lengths of which are adapted in such a way that their tip portions during rotation will sweep areas of the slanting screens 16 in short distance, and further the lowermost rotor members are arranged just above the bottom screen 14. The lowermost rotor members are situated so as to rotate in a common horizontal plane above the bottom screen 14, while the other rotor members are offset and arranged so as to rotate in areas partly overlapping each other.

Along its broad sides the container is provided with exterior wall plates 50 which together with the side plates 10 form a scavenging channel 52 closed at the sides by plate members 54. The wall plates 50 and the plate members 54 reach down closely above the netting 20 and confines a generally triangular space between the slanting bottom screen 16 and the netting 20, which space is shielded from the surrounding air except for the upper opening of the scavenging channel 52. The wall plate 50 has a right angular bending at the lower edge forming an air sluice 56 through which the netting can pass carrying a layer of fibres deposited thereon as described below.

In operation the axles 42 are rotated in the same direction by which the tips of the rotor members are moved at a velocity in the region of 50 meters per second. This speed is suitable for the treating of e.g. cellulosic fibres, but should be adapted according to the desired product and may vary within wide limitations. An airflow is created through the bottom screens 14,16 via the netting 20, the suction box and out through the exhauster 26. In the same manner air is sucked through the scavenging channels 52. A disintegrated material e.g. cellulosic fibre pulp is fed to the container through a fibre spreading inlet 58 up to approximately the level of the uppermost rotor members and agitated by means of the fast rotating members 48, which will thereby whip violently through the material. By the unidirectional rotation of the rotor members the fibre material is generally thrown against the opposed slanting screen walls 16, whereby the material profile will be somewhat as indicated by a dotted line a in FIG. 2. The material supported by the slanting screen walls is forced by the rotor members 48 to move along the respective walls so as to generally move relatively slowly in a flow around in the container along the sides and ends thereof. The fibres hereby passing the areas swept by the rotor members are vividly whipped and rearranged, and they maintain their state of being fluidized until with said flow they reach the next whipping area. Thus, the slanting bottom screens 16 and the outer edge portions of the bottom screen 14 are continuously being swept by an effectively fluidized current of fibres which can thus readily be sucked through the screens 14,16. Having passed these screens the fibres will follow the suction air and be deposited onto the netting 20 which separates the fibres from the air thus forming a sheet of loose fibre material which by the movement of the netting is carried through the sluice 56 for fixation or other desired purposes.

Some of the fibres are liable to adhere to the inner side of the outer wall 50,54, but are prevented from this by means of the scavenging air flowing down along the inner side of these walls after being oriented in the channel 52. Sucking some air this way towards the netting implies the advantage that possible areas of smaller thickness of the fibre layer on the netting has a tendency to be filled so as to show the desired evenness of the sheet of loose fibres, since more air will pass through the thinner areas than through the thicker areas, whereby more fibres will be directed from the upper dispersing zone adjacent the screen 16 towards the thinner areas in a concentration higher than generally found above the sheet. In this manner, should the fibres be dispensed at an increased rate from the screen portions adjacent the areas swept closely by the tips of the rotor members, the resulting uneven distribution of the fibres will thus be counteracted. it will be noted that the longest way of fibre passage from the screen to the netting is from the upper screen portions, i.e. the portions located near the highest speed area of the rotor member tips, i.e. the most active areas of fibre dispensing.

The flow of fibre material inside the container is turned at either end sections 2 and thrown around and upwardly along the half cones of the bottom portion 6 entering the area adjacent the ends of the cylindrical portion 9 from where the material is guided by means of guide plate members 60 down again along the lengthwise side portions and so forth. During the turning of the flow of material heavy particles or possible clusters of fibres or other scrap matters will concentrate in the area above the cone at the periphery, where they may be removed. For this purpose there is provided a tangential outlet pipe 62 the entrance of which is a horizontal slot partly covered by a slidably mounted plate member 64 for adjusting the height of the slot so as to control the outlet of e.g. scrap matters. It is possible to connect the outlet pipe 62 to recycle means in well known manner.

The rotor members 48 may have any of a variety of shapes for carrying out their whipping function, e.g. as shown in FIG. 5, where 4 designates the lower end of the axle 42 shown in the previous figures to which there is mounted two horizontal arm members 48' similar to the rotor members 48, but at the outer ends being interconnected by means of two inclined whip members 49. In this case the axles 4 should be spaced from each other so as to permit unidirectional rotation. Preferably the rotor members 48 should have more or less sharpened front edges 45, while the rear edges 49 can be flat as shown in FIG. 7 or the rear edges can be shaped or provided with flap members so as to enforce an areodynamic turbulence, facilitating the fluidizing of the fibres.

The apparatus should not necessarily be provided with three screens 14,16 of equal mesh, since by diligent choice of screen types it is possible to form a sheet of loose fibres consisting of e.g. two outer layers of one type of fibres and a midlayer of another type, the different types of fibres being sorted by means of the chosen types of screens. Tests have shown that the apparatus is usable even for fibres longer than those normally treated by apparatuses of the type considered.

FIG. 6 shown a modified embodiment in which the agitators are mounted for rotation about horizontal axles. The numerals indicating parts in the previous figures indicates equivalent means in FIG. 6. The container 1 is furnished with a modified bottom portion having a screen 15 the cross section of which is U-shaped with a straight bottom portion. Parallel to this there is arranged two horizontal axles 5 on each of which there is mounted a set of rotor members 148 arranged so as to rotate by means of the motor drive 38,40, each of the tips of the members 148 sweeping an area close to the screen 15 at a right angle to this. As indicated with rounded tip ends some of the impellers, designated 51, are shaped slightly like a propeller so as to create a general flow of fibres longitudinally along the curved sides of the screen 15 in one direction along one side and in the opposite direction along the other side. Thus, the impellers serve the combined purpose of whipping the material and moving it around in the container.

A very important feature of the invention, common to both the apparatuses shown in FIGS. 4 and 6, is that the impellers are arranged so as to rotate in a plane non-paralllel to the plane of the screens 15,16, the tips being close to these so as to maintain a zone of effectively fluidized fibres directed by means of the centrifugal forces towards the screen portions 15,16 generally in the direction in which the fibres will readily pass the screens. A feature also common for the two examples is the general flow of disintegrated material along the inner side of the screen portions 15,16 so as to facilitate an even output of fibres through the screens 15,16.

The container 1 should preferably, but not necessarily be covered by a lid section (not shown) of screen material permitting an escape of excess air if the fibres are fed through the fish-tail inlet 58 by means of transport air exceeding the amount of air being sucked via the exhauster 26, but keeping the fibres within the container.

The amount of fibres in the container 1 is controlled by controlling the rate of input in accordance with the output rate so as to maintain a constant profile of the fibre flow along the screens. However, experiments have surprisingly shown that it is possible to produce a sheet of evenly distributed fibres without maintaining said constant profile; it is in fact possible to feed the fibres botchwise into the container and still obtain even layers of fibres on the netting until the container is run practically empty, which is an outstanding advantage of the invention.

The whip members may be of any suitable design, e.g. constituted by wire members, and they may be arranged for rotation in any suitable manner such that the tip portions thereof are moved repeatedly towards and away from the screen portion cooperating with the whip member.

The slide gate 32 for controlling the suction area may be subdivided into sections as indicated with dotted lines in FIG. 3. The sections may then be individually operated so as to adjust the shape of the suction area 28 and in this way control possible variations in the thickness across the sheet of loose fibres, i.e. if the sheet should be provided with a longitudinal zone in which the layer of fibres is thicker or thinner, the section or sections beneath the zone should be positioned so as to increase or decrease respectively the suction area in question. By continuos operation during a longer period of time parts of the screen may be clogged up or choked by fibres or foreign matters, whereby a thinner zone of the sheet may be produced. This can be counteracted by means of the individually operable gate sections and may be controlled by automatic means. It will be appreciated that this method of controlling the thickness of a sheet material formed by suction not only is suitable for correcting the uniformity of the cross section of the sheet, but also can be used advantageously as a control means for the thickness of the sheet in general. This thickness control means may further be used in connections other than that of the present invention, i.e. where a submatters of a material is deposited on a forming surface by means of suction.

It should be noted that the slanting screen walls should preferably be provided with the perforations showing free openings as seen in the direction of the centrifugal forces of the rotor members, thus facilitating the penetration of the fibres through the screen. A minor disadvantage of this would be that some fibres were directed directly towards the inner surface of the exterior wall plate 50, so as to build up upon these and give rise to the risk of clumps of articles falling down upon the the sheet of fibres, but this risk is counteracted by means of the scavenging current through the channel 52. Another way of overcoming this problem could be the substituting of the wall plate 50 by a horizontal roller covering with part of its surface the triangular space between the screen 16 and the web. In this way the fibres deposited upon the roller surface can be continously removed and the scavenging channel 52 and the sluice 56 may be omitted.

The preceding discussion of FIGS. 1-7 corresponds to the disclosure in applicant's above-noted earlier U.S. applications, and is presented so as to provide a complete understanding of the following further development of the invention.

FIG. 8 shows schematically a distributor container 1 having a more pronounced V-shape than shown in FIG. 2. Moreover the outer wall plates 54 are inclined so as to be more or less parallel with the respective side portions 16 of the fibre classifying screen 14 of the container, whereby the scavenging channels 52 are correspondingly narrow. Two important advantages are obtained hereby, viz. that the air flow in each of the channels 52 is concentrated so as to sweep along the channel confining surfaces with a relatively high velocity all the way down, and that the distance between the lower edges of the opposed wall plates 54 is relatively small compared with FIG. 2, whereby also the suction box 24 can be designed to be correspondingly narrow. Adjustable air valves 53 are shown located in the upper end portions of the channels 52.

As previously mentioned the fibers are preferably fed to the container 1 from a hammer mill through a pipe which may be connected directly to the fishtail inlet 58 shown in FIGS. 1 and 4. Since the hammer mill produces a flow of outlet air in which the disintegrated fibers are suspended this air flow will intrude into the container and will normally by far exceed the air flow as sucked away by the suction box 24. It is preferred, therefore, to arrange for separator means receiving the fiber laden air flow from the hammer mill and causing the fibers to be stopped by some suitable screen element, from which the fibers are caused to fall down into the container 1 while the air flow as such is caused to pass through the screen element and to be exhausted from the separator without effecting aerodynamic disturbance inside the container 1. This separation principle is well known in the art, since a surplus of transportation air of the fibers would cause troubles in any type of distributor device 1, but it is worth noting that the problem even in connection with the present invention may be overcome in the traditional manner by arranging for an air/fiber separator means above the container 1 as shown at 70 in FIG. 1. The separator receives a flow of fiber laden air from a hammer mill 72 having an air intake 74 and an intake for a pulp material 76 to be disintegrated. From the separator 70 the fibers are delivered to the container 1 through an outlet 78, while the air leaves the separator through an air outlet 80 which may be connected to the air intake 74 of the hammer mill 72.

A particularly advantageous design of the air/fiber separator 70 is illustrated in FIG. 9. It consists of a housing 82 having an upper inlet 84 for the fiber laden air from the hammer mill and a rotary cylinder 83 mounted inside the housing and rotated by means of a motor (not shown). The cylinder 86 is made of a screen material and its interior communicates endwise with the air outlet 80 (cf. FIG. 8). The lower half of the cylinder is internally, by means of a stationary mantle element 88, insulated from the space communicating with the outlet 80, and the cylinder is arranged as a rotary partition element between the upper and the lower portion of the housing 82. In operation, therefore, the air flow from the inlet 84 will penetrate the upper portion of the cylinder and leave the interior of the cylinder through the outlet 80, and the fibers will be deposited on the top side of the upper cylinder portion. As the cylinder is steadily rotated the deposited fibres will be continually removed from the deposition area and moved downwardly until they appear on the lower side of the cylinder, where they are no longer forced or held against the cylinder surface by any air flow. Consequently the fibers will simply tend to fall off the cylinder for transfer into the container; should the fibers adhere somehow to the cylinder surface they may be removed by means of a scraper 90, or even by way of a feeble air flow outwardly through the lower portion of the cylinder surface as caused by a supply of overpressure air to the space defined by the shield element 88 or to a narrower space defined by a separate shield or channel member 92 shown in dotted lines.

Compared with FIGS. 1-4 the rotors 42,48 of FIG. 8 are generally of smaller diameter, whereby the width of the horizontal screen bottom portion 14 is correspondingly small, this contributing to the said smaller width of the suction box 24. Another advantage of the small diameter rotors is that the rotors may be arranged correspondingly closer to each other, as illustrated in FIG. 10, whereby the outer triangular areas which are left non-engaged by the rotors, as marked by hatchings A in FIG. 10, will be correspondingly smaller, and the small size of these areas is desirable because they represent areas of decreased centrifugal action on the fibers towards the screen walls 16.

The use of rotors of relatively small diameter may involve the need of rotating them at increased speed in order to maintain sufficient tip velocity for the desired whipping and slinging effect thereof. In practice, however, there is no problem in providing for the necessary speed of rotation of the rotors or impellers.

It will be observed from FIG. 8 that the horizontal screen bottom portion 14 constitutes a smaller part of the entire distributor screen arrangement 14,16 as compared with FIG. 2. As already mentioned, however, the horizontal bottom portion is relatively unimportant as far as the distributing capacity of the container 1 is concerned, so the reduced width of this portion does not cause any disadvantage with respect to the capacity of the system.

A further effect of the relatively steep inclination of the side screen wall portions 16 of the container 1 as shown in FIG. 8 and 10 is that the difference between the diameters of the uppermost and the lowermost of the impellers 48 is relatively small, whereby, when the rotors are placed so as to generally overlap each other with the smallest possible mutual distance between their shafts 42, as given by the diameter of the uppermost, longest impellers, the lowermost impellers of two neighbouring rotors will be located generally closer to each other as compared with FIGS. 1–4. Hereby a relatively larger percentage of the flat bottom area of the container 1 is swept by the lowermost impellers, and the possibility of fiber lump formations on the flat bottom portion 14 is thus reduced. Such formations would result in a partial choking of the bottom portion, whereby the general air flow through this portion would become uneven and thus tend to produce a non-uniform distribution of the air flow underneath the bottom, just above (and through) the foraminous sheet 20, this giving rise to an uneven fiber deposit on this sheet. Therefore, the evenness of the fiber layer deposited on the screen 20 will be improved when the lowermost impellers 48 sweep over an enlarged partial area of the bottom screen portion 14 for preventing fiber lump formations as far as possible.

The said lump formations on the horizontal bottom portion would be harmless if this portion was not penetrated by the air flow resulting from the suction applied by the suction box 24, because the lumps would not then cause any non-uniformity of the air flow underneath the horizontal bottom portion. Therefore, since this bottom portion is unimportant from a distributing capacity point of view, it should seem natural to suggest this bottom portion simply to be closed, i.e. to be non-perforated, whereby said lump formations would do no harm. However, while such closing of the bottom portion would be harmless as seen from the interior of container 1 it would nevertheless be hazardous as seen from the foraminous sheet 20, because a closed bottom plate 20 would be liable to attract, by static electricity, fibres from the fiber layer already deposited on the sheet 20, such that lump formations might occur of the underside of the horizontal bottom portion, when the fibers are not blown away therefrom by the air flow otherwise penetrating this bottom portion. Such lump formations might be harmless if they sticked to the underside of the bottom portion (when non-perforated), but they will have a tendency to grow to such a size where they cannot be held back by the bottom surface, and thus they will fall down onto the sheet 20 and form highly undesired fiber lumps thereon. So far, therefore, it is preferred to make use of a perforated bottom portion 14.

Fiber lump formation may take place anywhere inside the container 1, or such lumps may be supplied with the flow of fibers introduced into the container 1. The major amount of these lumps will be disintegrated by the action of the whipping impellers 48, but some lumps may survive the action of the impellers. These lumps, together with the loose fibers surrounding them, are circulated in the container 1 by the action of the impellers 48, and the lumps are generally thrown upwardly along the inclined side walls 16 so as to be collectable through the opening 62 shown in FIG. 1. However, it would be desirable to provide for means to cause disintegration of the lumps, and FIG. 11 illustrates an improvement in this respect.

FIG. 11 shows a modified container 1' in which the frustro conical end wall portions 6 of FIG. 1 are substituted, at least at one end of the container, by an arched duct member 94 connected to the respective end of the container through openings 96 located in a transverse end wall portion 98 just inside the corner areas between the wall portion 98 and the side wall portions 16, whereby the flow of fibres along one side wall may continue into one end of the duct 94 and pass through the duct for continuous redelivery to the container through the other end of the duct. If necessary, in order to support the fiber flow through the duct it is possible to arrange for air nozzles 100 connected to a source of pressurized air so as to be operable to provide an air flow which shall only be strong enough to carry the fibers through the duct and maintain them suspended in air. These air nozzles or other nozzles 102 located at any convenient place inside the duct 94 may act as "air knives" showing a disintegrating effect on fiber lumps passing along with the fiber flow. As apparent from FIG. 11, the duct 94 is preferably shaped so as to have a narrowed middle portion 104 in which the nozzles 102 are placed, whereby the entire fiber flow will be treatable for lump disintegration by means of relatively few air nozzles.

FIG. 11 additionally serves to show that the lower horizontal bottom portion 14 need not be flat, as it may even advantageously be convex as shown at 14', whereby the unitary screen forming the wall portions 14 and 16 is mechanically stabilized between the opposed end wall structures to which it is secured. Still, the bottom portion itself is unimportant as far as fiber delivery from the container 1 is concerned, and from this point of view it is also unimportant that by the rounded shape of the bottom portion it is more difficult to make the bottom wings of the impellers sweep generally closely above the bottom.

It should be mentioned at this place that in connection with the present invention it has been found, contrary to the teaching of said British patent specification No. 1,207,536 and especially the corresponding West German patent specification No. 18 07 411, that in practice it is perfectly possible and even highly advantageous to make use of the side walls of the container as the active fiber distributor elements. The fibers leave these wall portions at different levels and thus with different falling heights down to the foraminous sheet 20, but this fact seems to be without any adverse effect on the uniformity of the fiber layer deposited on the sheet. The use of the side screen walls in connection with the centrifugal effect of the impellers for slinging the fibers against the walls is a concept of using a plane bottom screen and agitators working parallel therewith, and generally the invention provides for a high capacity without comprimising the obtainable uniformity of the fiber layer to be produced.

The impellers may be given such a propeller-like shape, though to a small degree only, that they assist in keeping the fiber material distributed all over the height of the container side wall portions 14, whereby these wall portions may even be vertical as shown in FIG. 12. As far as the bottom wings in general are concerned these may be shaped alternatively as fan wheels serving to actively remove fibre material from the bottom portion 14, as far as possible, in order to counteract deposition of fiber lumps thereon.

Thus it is endeavored to hold the bottom portion 14 free of fibers, but it should be taken into account that this involves air to be sucked right through the bottom portion into the suction box 24, and this air can be considered as lost suction air, because it does not serve the purpose of carrying fibers down to the foraminous screen.

Generally, therefore, the bottom element 14 is of no advantage since it is unimportant as distributor element and may cause inconvenience due to its being open for penetration of air. On this background it should seem possible to overcome the problems in a very simple manner, viz. simply by making this bottom portion or at least the ineffective part thereof non-perforated. This, however, would induce severe problems especially adjacent the lower surface of the bottom plate where fibres from the layer already deposited on the screen 20 would get attracted by way of static electricity, this resulting in a gradual building up and sudden release of fibre lumps. Thus, the air flow downwardly from the bottom is essential for avoiding deposit of fibres on the lower bottom side.

According to an important aspect of the present invention the problem is solved by substituting for the perforated bottom portion 14 a bottom member which dies not permit air to be sucked right through it, but which is nevertheless able to produce an air flow generally downwardly sufficiently to prevent fibres from getting deposited on its underside. Such a plate member is illustrated in FIG. 12, designated 14''.

The plate member 14'' is a construction comprising a lower plate A and a parallel upper plate B and an air space C therebetween. The space C is connected through a pipe or hose D to a source of pressurized air (not shown). At least the lower plate A is made permeable to air, whether finely perforated or consisting of a semipermeable porous material, of metallic or ceramic or any other nature, whereby the overpressure air inside the space or chamber C will "seep" out downwardly through the plate A and thus produce in general a downwardly directed air flow from all lower surface portions of plate A. It is obtainable hereby that this air flow is sufficient for preventing fibre deposits on said lower surface without being strong enough to cause disturbance of the fibre layer already deposited on the underlying screen 20.

The upper plate member B may be entirely closed or solid or it may be made of the same or any other air permeable material as the plate. If it is air permeable it will produce an upwardly directed air flow which will prevent fibre deposits thereon, but such deposits on the bottom top side are, by themselves, far less disturbing than the said lumps on the lower bottom surface. The most important result is that fibre formations on the bottom top surface (whether or not this produces an upwardly directed air flow) will now be unable to affect in any way the downwardly directed air flow from the lower bottom surface, i.e. the latter can remain uniform despite any non-uniform fibre covering of the bottom top surface.

In the specific connection here described the use of a composite bottom structure 14'' of which the upper layer B may even be entirely closed or solid, and which need not as a whole be constituted by a thin, perforated sheet, involves the further advantage that the bottom structure may be designed rigidly enough to form a mounting base for lower bearings of the shafts 42 of the impellers 48, as shown in dotted lines at 15.

FIG. 13 is a sectional view of a modified embodiment in which is used a double rotor system comprising a row of rotors along each of the opposed side wall portions 16, all rotors being rotated the same way. The bottom of the container is a double plate structure corresponding to the bottom 14'' of FIG. 12, with the top plate element $B_1$ bent into two angularly oriented flat sections to suit the lower ends of the opposed rotors.

In FIG. 14 is shown a particularly advantageous design of the above discussed bottom structure 14'', this here being shaped as a generally triangular, hollow beam 14'' having a horizontal top side portion B' and downwardly-inwardly inclined side wall portions A', at least the latter being more or less finely perforated. With such a construction the bottom beam will constitute a rigid element, even when made of relatively thin sheet material and it may serve as a lower support means for the perforated side walls 16; these may be made of one single sheet of perforated plate or net material which is folded upwardly about the bottom edge of the beam 14'', whereby the beam sides A' are entirely covered by the wall material 16. Obviously, however, when an overpressure is applied to the interior of the beam 14'' the air may still escape through the perforated walls A' and through the netting portions covering these walls, the netting even showing a certain distributor effect whereby the perforation of the walls A' need not be particularly fine.

Thus, the beam 14'' may structurally serve as a bottom holder means for the wall netting 16, which is thereby easy to mount in a stretched, well defined position. Moreover the beam may be thick enough to make the overpressure as applied from one or both ends thereof easily transferable to all parts of the inner space of the beam. The beam top side B' may be perforated if required.

The use of the beam 14'' or a similar structure further involves a substantial advantage in that the distributor box may now be almost sharply V-shaped, as shown in FIG. 15, in such a manner that the above discussed bottom problems are practically eliminated, because from a fibre distribution point of view there is no bottom left at all, the distributor now practically consisting of side walls only. As shown in FIG. 15, external air may be caused to be drawn downwardly along the outsides of the perforated walls 16 towards a narrow area of the foraminous screen 20 underneath the beam bottom of the distributor box, and accordingly the suction box 24 may be relatively narrow, as compared with that shown in FIG. 2.

Especially if the beam top side B' is not perforated or otherwise air permeable, it may be preferable to substitute for the lowermost rotor wing a fan wing or wheel operable to create an air flow counteracting the formation of fibre lumps on the top surface of the beam.

FIG. 15 further shows that fibre inlet guiding plate members 17 may be arranged, if desired in an adjustable manner, in the top inlet portion of the container 1. Moreover, if desired, a positive air supply may be effected, by suitable blower means, to the upper end of the scavenging channels 52, as indicated by arrows 55.

The bottom beam 14'' may even be solid or entirely non-perforated, as with some types of fibers there are no problems of the fibers forming lumps on the underside portions of the beam, especially because these are not located in a draughtfree zone.

The outer side walls 54 may be adjustable to assume various angular positions non-parallel to the side screen walls 16.

FIG. 16 shows an enlarged sectional view of the lower end of the distributor as shown in FIG. 15, and it is illustrates how a fiber layer F is built up on the foraminous sheet 20 as viewed moving toward the left, whereby of course the layer in the deposit area will be of gradually increased thickness towards the left. The suction box 24 in this figure is provided with a vertical partition 25 projecting almost entirely up to the underside of the foraminous sheet and dividing the suction box into two chambers each having a separate outlet 26 connected to the suction side of a blower (not shown), either to individual suction blowers or to a common suction blower through suitable tube and valve means. With this arrangement it will be possible, therefore, to differentiate the suction in the two chambers of the suction box such that the suction from the left chamber is stronger than from the right hand chamber. Hereby, it is possible to control the suction in such a manner that the intensity of the air flow crossing the foraminous sheet through the relatively thin fiber layer $F_1$ above the right hand chamber will not be much higher than the air flow intensity through the relatively thick fiber layer $F_2$ above the left chamber, the fiber layer of course presenting an air flow resistance proportional with the thickness of the layer. The air flow, generally, should be optimized so as to be neither ineffectively weak nor uneconomically strong, and the described arrangement facilitates such as optimizing. Still better results, of course, would be achievable with the suction box divided into more than two chambers as seen in the moving direction of the sheet 20, whereby the suction could be controlled in a still more differentiated manner.

The differentiated suction should preferably be controlled in such a manner that the absolute or static air pressure is approximately the same adjacent the top side of the deposited fiber layer portions $F_1$ and $F_2$.

Generally it will be highly desirable to control the suction through the box 24 and the positive supply of air to the scavenging channels 52 in such a manner—even taking into account the air supplied to the scavenging channels through the classification screen 16—that the static air pressure in the fiber deposit area is as close as possible to the ambient air pressure, because it will then be prevented that an air flow is liable to be created outwardly or inwardly through the slot areas between the foraminous sheet 20 and the lower edges of the side walls 54, i.e. the disturbance of the fiber layer as caused by such an effect will be minimized or eliminated.

What I claim is:

1. Apparatus for depositing and distributing loose fibers or particles onto a surface of a moving carrier web comprising:

(a) supply means for supplying a flow of fiber or particle laden air;

(b) air separator means for receiving said fiber or particle laden air and separating the air from fibers or particles contained therein, said air separator means having air discharge means and separated fiber or particle discharge means;

(c) a housing having inlet means and outlet means for said fibers or particles, said inlet being in communication with said separated fiber or particle discharge means;

(d) a moving carrier web having a surface positioned adjacent the outlet end of said housing;

(e) screen means within said housing between said inlet and outlet means, at least part of said screen means being arranged so as to extend in a manner which is transverse and non-parallel with respect to the surface of the moving carrier web;

(f) agitator means within said housing for creating a flow of said particles or fibers about an axis extending in a plane that extends normal to said surface and parallel to a direction of movement of said carrier web, and for directing said particles or fibers outwardly against and through said screen means; and (g) means for directing particles or fibers passing through said screen means to said moving carrier web whereby said particles or fibers are deposited in a layer upon said moving carrier web.

2. Apparatus according to claim 1, wherein said air separator means comprises a separator housing having fiber or particle laden air inlet means for receiving said air flow, rotary separating means mounted in said separator housing for separating said fibers or particles from said air flow, first means in communication with a first side of said rotary separating means for discharging separated fibers or particles from said separator housing, and second means in communication with a second side of said rotary separating means for discharging said air after separation of said fibers or particles.

3. Apparatus according to claim 2, wherein said rotary separating means comprises a hollow cylindrical screen, said first means comprises a first outlet in communication with the outside of said screen, and said second means comprises a second outlet in communication with the inside of said screen, and comprising means for removing said fibers or particles from said screen.

4. Apparatus according to claim 3, wherein said screen is mounted to extend horizontally in the separator housing, said air inlet means is in a wall of said housing located above said screen, said first outlet is located below said cylindrical screen and wherein said means for removing comprises an air impervious shield positioned so as to block air entering through upper portions of said cylindrical screen from exiting through lower portions of said cylindrical screen.

5. Apparatus according to claim 4, wherein said means for removing includes scraper means positioned adjacent a lower exterior area of said screen.

6. Apparatus according to claim 1, wherein said housing has a lowermost bottom portion, said bottom portion, in use, being impermeable to said particles or fibers.

7. Apparatus according to claim 6, wherein said bottom portion comprises a lower bottom portion and an upper bottom portion and a free, closed space therebetween, at least said lower bottom portion being perforated to allow air to seep out therethrough when said space is connected with a source of pressurized air.

8. Apparatus according to claim 6, wherein said bottom portion comprises a beam of generally triangular transverse cross-section.

9. Apparatus according to claim 6, wherein said screen means is connected to said beam and extends upwardly and outwardly with respect thereto.

10. Apparatus according to claim 1, wherein said screen means is substantially V-shaped in transverse cross-section.

11. Apparatus according to claims 1 or 10, comprising air flow means for producing a flow of said fibers or particles from said screen means to the said carrier web.

12. Apparatus according to claim 11, wherein said air flow means comprises means for producing a scavenging air flow downwardly along exterior surfaces of said screen means.

13. Apparatus according to claim 12, wherein said air flow means includes a suction box disposed beneath said carrier web for drawing air therethrough.

14. Apparatus according to claim 13, wherein said suction box is divided into high suction and low suction forming zones, said high suction zone being disposed downstream of said low suction zone with respect to the direction of travel of said moving carrier web.

15. Apparatus according to claim 11, wherein said air flow means includes a suction box disposed beneath said carrier web for drawing air therethrough.

16. Apparatus according to claim 15, wherein said suction box is divided into high suction and low suction forming zones, said high suction zone being disposed downstream of said low suction zone with respect to the direction of travel of said moving carrier web.

17. Apparatus according to claim 1, wherein said outlet means is located near said carrier web and said inlet means is located thereabove, and said axis extends between said inlet and outlet means.

18. A method for depositing and distributing loose fiber or particle material onto a surface of a moving carrier web comprising the steps of:

(a) supplying a flow of loose fiber or particle material laden air;

(b) separating the air from fiber or particle material contained therein;

(c) feeding the separated loose fiber or particle material into a housing having an inlet and outlet for said material, the outlet being positioned adjacent a surface of a moving carrier web;

(d) agitating said material within said housing by creating a flow of said material about an axis extending in a plane that extends normal to said surface and parallel to a direction of movement of said carrier web, and directing said material outwardly against a screen means which is located in said housing and at least in part extends in a manner which is transverse and non-parallel to said surface of the moving carrier web and through said screen means; and (e) directing material passing through the screen means to said movable carrier web so that said material is deposited in a layer upon the surface of the moving carrier web.

19. Method according to claim 18, wherein said flow is created about an axis oriented vertically with respect to said carrier web.

20. In an apparatus for depositing and distributing loose fibers or particles onto a surface of a moving carrier web of the type wherein a distributor housing and means for creating a flow of said particles or fibers about an axis extending in a plane that extends normal to said surface and parallel to a direction of movement of said carrier web and directing said flow of fibers or particles outwardly with respect to said axis, against and through a screen means oriented at least in part so as to extend transversely and non-parallelly with respect to the surface of the moving carrier web are provided, said screen means being mounted in said distributor housing with all surfaces of said screen that are particle or fiber permeable in use extending from a lower portion of said distributor housing, upwardly with respect to said surface of the moving carrier web.

21. Apparatus according to claim 20, wherein said housing has a lowermost bottom portion, said bottom portion, in use, being impermeable to said particles or fibers.

22. Apparatus according to claim 21, wherein said bottom portion comprises a lower bottom portion and an upper bottom portion and a free, closed space therebetween, at least said lower bottom portion being perforated to allow air to seep out therethrough when said space is connected with a source of pressurized air.

23. Apparatus according to claim 21, wherein said bottom portion comprises a beam of generally triangular transverse cross-section.

24. Apparatus according to claim 21, wherein said screen means is connected to said beam and extends upwardly and outwardly with respect thereto.

25. Apparatus according to claim 20, wherein said screen means is substantially V-shaped in transverse cross-section.

26. Apparatus according to claims 20 or 25, comprising air flow means for producing a flow of said fibers or particles from said screen means to below said carrier web.

27. Apparatus according to claim 26, wherein said air flow means comprises means for producing a scavenging air flow downwardly along exterior surfaces of said screen means.

28. Apparatus according to claim 27, wherein said air flow means includes a suction box disposed beneath said carrier web for drawing air therethrough.

29. Apparatus according to claim 28, wherein said suction box is divided into high suction and low suction forming zones, said high suction zone being disposed downstream of said low suction zone with respect to the direction of travel of said moving carrier web.

30. Apparatus according to claims 20 or 24, wherein said distributor housing has inlet and outlet means for said fibers or particles, said outlet means being located near said carrier web, said inlet means being located above said outlet means, and said axis extending between said inlet and outlet means.

31. Apparatus according to claim 20, wherein said flow creating means comprises a plurality of rotary agitator means.

32. Apparatus according to claim 31, wherein said rotary agitator means comprise whip members mounted to pass closely adjacent portions of said screen means.

33. Apparatus according to claim 32, wherein each of said rotary agitator means are rotatable about a respective axis, and said rotary agitator means being positioned at locations spaced transversely across said carrier web.

34. Apparatus according to claims 20 or 24, wherein said axis is oriented substantially vertically.

35. Apparatus according to claim 20, 21 or 22, wherein said flow creating means is an agitator device having a shaft and impellers, said shaft being rotationally mounted in lower bearings supported upon a bottom wall of the housing.

36. A method for depositing and distributing loose fibers or particles onto a surface of a moving carrier web of the type wherein a flow of said fibers or particles is created about an axis extending in a plane that is normal to said surface and parallel to a direction of movement of said carrier web and directed outwardly, with respect to said axis, against and through fiber or particle permeable areas of a screen means oriented at least in part so as to extend transversely and non-parallelly with respect to the surface, said screen means being mounted within said distributor housing with all of said fiber of partical permeable areas extending, from a bottom portion of said distributor housing, upwardly with respect to said surface of the moving carrier web.

37. Apparatus for depositing and distributing loose fibers or particles onto a surface of a moving carrier web of the type wherein a distributor housing for the fibers or particles extends across said carrier web on a first side thereof, said housing having inlet and outlet means, for particles or fibers, comprising suction means provided on a second, opposite, side of said carrier web, for drawing air through said surface of the carrier web, screen means interposed between said inlet and outlet means with all surfaces thereof that are particle or fiber permeable surfaces in use extending upwardly with respect to said surface of the moving carrier web, and means within said housing for applying a positive displacement force to said particles or fibers for directing them in a flow toward said outlet about an axis extending within a respective plane that is normal to said surface and parallel to a direction of movement of said moving carrier web and outwardly, with respect to said axis, in order to promote flow of said fibers or particles through the screen means and outlet independently of said suction means.

38. Method of distributing loose fibers or particles onto a surface of a moving carrier web, wherein the fibers or particles to be distributed are fed into a distributor housing extending across the carrier web on one side thereof and having screen means arranged with all particle or fiber permeable surfaces thereof extending upwardly with respect to said surface of the moving carrier web and outlet means through which the fibers or particles are directed toward said surface, air is sucked through the web from another side of said carrier web to ensure deposition of the material on the web in a well defined manner, and a flow of particles is created in said housing about an axis extending in a plane that is normal to said surface and parallel to a direction of movement of said carrier web for directing the fibers or particles in a flow outwardly, with respect to said axis, through said screen means and said outlet means to said surface of the carrier web independently of said suction of air.

39. Method according to claim 38, wherein said air sucking and flow directing is performed so as to maintain static air pressure in an area of fiber or particle deposition on said carrier web substantially at ambient air pressure.

* * * * *